US005814587A

United States Patent [19]

Vrahopoulou et al.

[11] Patent Number: 5,814,587

[45] Date of Patent: Sep. 29, 1998

[54] LUBRICATING OIL CONTAINING AN ADDITIVE COMPRISING THE REACTION PRODUCT OF MOLYBDENUM DITHIOCARBAMATE AND METAL DIHYDROCARBYL DITHIOPHOSPHATE

[75] Inventors: Elisavet P. Vrahopoulou, Chatham; Richard S. Polizzotti, Milford; Daniel Paul Leta, Flemington; Stephan D. Cameron, Milford, all of N.J.

[73] Assignee: Exxon Research and Engineering Company, Florham Park, N.J.

[21] Appl. No.: 766,828

[22] Filed: Dec. 13, 1996

[51] Int. Cl.[6] ..... C10M 159/12

[52] U.S. Cl. ..... 508/363; 508/365; 508/420

[58] Field of Search ..... 508/363, 365, 508/420; 556/31, 39

[56] References Cited

U.S. PATENT DOCUMENTS

| | | | |
|---|---|---|---|
| 4,178,258 | 12/1979 | Papay et al. | 252/32.7 E |
| 4,395,343 | 7/1983 | de Vries et al. | 252/32.7 E |
| 4,479,883 | 10/1984 | Shaub et al. | 252/32.7 E |
| 4,529,526 | 7/1985 | Inoue et al. | 252/32.7 E |
| 4,786,423 | 11/1988 | Schroeder | 252/32.7 E |
| 4,966,719 | 10/1990 | Coyle et al. | 252/42.7 |
| 4,978,464 | 12/1990 | Coyle et al. | 252/42.7 |
| 4,995,996 | 2/1991 | Coyle et al. | 252/42.7 |
| 5,356,547 | 10/1994 | Arai et al. | 252/46.4 |

FOREIGN PATENT DOCUMENTS

| | | |
|---|---|---|
| WO9428095 | 12/1994 | WIPO . |
| WO9519411 | 7/1995 | WIPO . |

OTHER PUBLICATIONS

Shibahara, et al.; Coord. Chem. Rev. 123, 73–148 (1993).
Rounds; Tribology Transactions, 33, 345–354 (1990).
Hong; Lubrication Engineering, 50, 616–622 (1994).

*Primary Examiner*—Jerry D. Johnson
*Attorney, Agent, or Firm*—Joseph J. Allocca; Jay Simon

[57] ABSTRACT

Multifunctional molybdenum compounds, which are the reactive product of molybdenum dithiocarbamates and metal dihydrocarbyl dithiophosphates, are new compositions which are useful as lubricant additives. They impart to the lubricant formulations to which they are added low friction and excellent wear properties at reduced phosphorous concentrations.

6 Claims, 5 Drawing Sheets

LUBRICATING OIL CONTAINING AN ADDITIVE COMPRISING THE REACTION PRODUCT OF MOLYBDENUM DITHIOCARBAMATE AND METAL DIHYDROCARBYL DITHIOPHOSPHATE

BACKGROUND OF THE INVENTION

1. Field of the Invention

This invention relates to lubricating oils containing additives which impart low friction and antiwear characteristics.

2. Description of the Related Art

The reduction in friction and improved antiwear performance in lubricants has been pursued in the industry for a number of years.

U.S. Pat. No. 4,178,258 teaches a lubricating oil for use in spark ignition and compression ignition engines which exhibits enhanced antiwear and friction characteristics by containing an antiwear amount of a molybdenum bis(dialkyl dithiocarbamate). The lubricant is described as being especially effective in reducing wear and friction if the lubricant also contains a zinc dialkyldithiophosphate (ZDDP).

U.S. Pat. No. 4,395,434 teaches an antioxidant additive combination for lube oils prepared by combining (1) a sulfur containing molybdenum compound prepared by reacting an acidic molybdenum compound, a basic nitrogen compound and carbon disulfide with (2) an organic sulfur compound. The organic sulfur compound is described as including metal dialkyldithiophosphates, and metal dithiocarbamates, among other organic sulfur compounds.

U.S. Pat. No. 4,529,526 teaches a lubricating oil composition comprising a base oil and a sulfurized oxymetal organic phosphorodithioate and/or a sulfurized oxymetal-dithiocarbamate and at least one zinc alkylcarbyl dithiophosphate, along with a calcium alkybenzene or calcium petroleum sulfonate and an alkenylsuccinic acid imide.

U.S. Pat. No. 4,786,423 teaches an improved lubricant which contains a mineral or synthetic base stock oil and two heavy metal compounds as well as a metal and sulfur free phosphorous compound. The heavy metal compounds can be molybdenum dithiocarbamate in combination with zinc dialkyldithiophosphate. The other phosphorous compound can be trialkyl or triaryl phosphate. The lubricant is prepared by, for example, heating the base stock to between room temperature and about 100° C. for two hours, then adding the subsequent components to the heated oil approximately 20 minutes apart under the referenced elevated temperature.

WO 95/19411 (PCT/US95/00424) is directed to additives for lubricants which are combinations and reaction products of metallic dithiocarbamates and metallic dithiophosphates. The preblended combinations and reaction products are described as showing good stability and compatibility when used in the presence of other commonly used additives in grease or lubricant compositions. The metals of the metal dithiophosphates and metal dithiocarbamates may be selected from nickel, antimony, molybdenum, copper, cobalt, iron, cadmium, zinc, manganese, sodium, magnesium, calcium and lead. The combination and reaction products are described as providing enhanced friction reducing and anti-wear properties at extreme pressure. Additional anti-oxidation, cleanliness, anti-fatigue, high temperature stabilizing and anti-corrosion properties are also described as potentially present. The metallic dithiocarbamate and metallic dithiophosphate are mixed, generally at any suitable conditions with temperatures varying from −20° C. to 250° C., preferably between 50° C. and 150° C. Reaction rather than blending will usually occur if the temperature is between 70° C. and 100° C. The metallic dithiocarbamates and the metallic dithiophosphates may be combined in any ratio from 1:9 to 9:1. In the Examples, reaction temperatures of only 80° C. to 100° C. were employed.

U.S. Pat. No. 4,812,246 teaches a lubricating composition comprising a particular base oil and additives comprising a phenol based antioxidant and/or organomolybdenum compounds such as molybdenum dithiocarbamate. The lubricating composition can also contain other common additives such as zinc dialkyl dithiophosphates, etc.

It is well known in the art that in formulating engine oils, there is a delicate balance between friction and wear performance. According to the literature [Kubo et al, *Toraiborojisuto,* 34(3), 185 (1989)], organomolybdenum compounds compete with ZDDP for the metal surface. The structure and friction coefficient of the film depends on the surface affinity of the two compounds. ZDDP adsorbs onto the metal surface first to form a film, on top of which adsorbs MoDTC to form a shearable film rich in molybdenum and sulfur [M. Muraki and H. Wada, *Toraiborojisuto,* 38(10), 919 (1993)].

The amount of ZDDP that can be added is limited by industry concerns. Apparently, the phosphorous contained in some additive compounds may affect the catalytic converters in modern vehicles. It is anticipated that future engine oil specifications will have lower limits on phosphorous concentrations, and there are additional concerns on whether such a reduction would affect the antiwear performance of engine oils.

It would be desirable to have an engine oil with improved friction performance, wear protection, and low phosphorous concentration to meet the increasing performance demands placed on modern oils.

SUMMARY OF THE INVENTION

This invention is a method for forming a lubricating composition comprising adding to a major amount of an oil of lubricating viscosity a minor amount of metal dihydrocarbyl dithiophosphate and molybdenum dithiocarbamate, and heating the admixture in air to a temperature ranging from above about 135° C. to about 200° C. thereby forming a lubricating composition.

In another embodiment, the invention is a lubricating composition formed by adding to a major amount of an oil of lubricating viscosity a minor amount of the reaction product formed upon heating the admixture of metal dihydrocarbyl dithiophosphate and molybdenum dithiocarbamate in air to a termperature ranging from above about 135° C. to about 200° C.

In still another embodiment, the invention is a method for enhancing the friction reducing and wear reducing properties of a lubricating composition comprising adding to a major amount of an oil of lubricating viscosity a minor of the reaction product formed upon heating the admixture of metal dihydrocarbyl dithiophosphate and molybdenum dithiocarbamate in air to a temperature ranging from above about 135° C. to about 200° C. in the presence of air.

DESCRIPTION OF THE INVENTION

Figure 1:
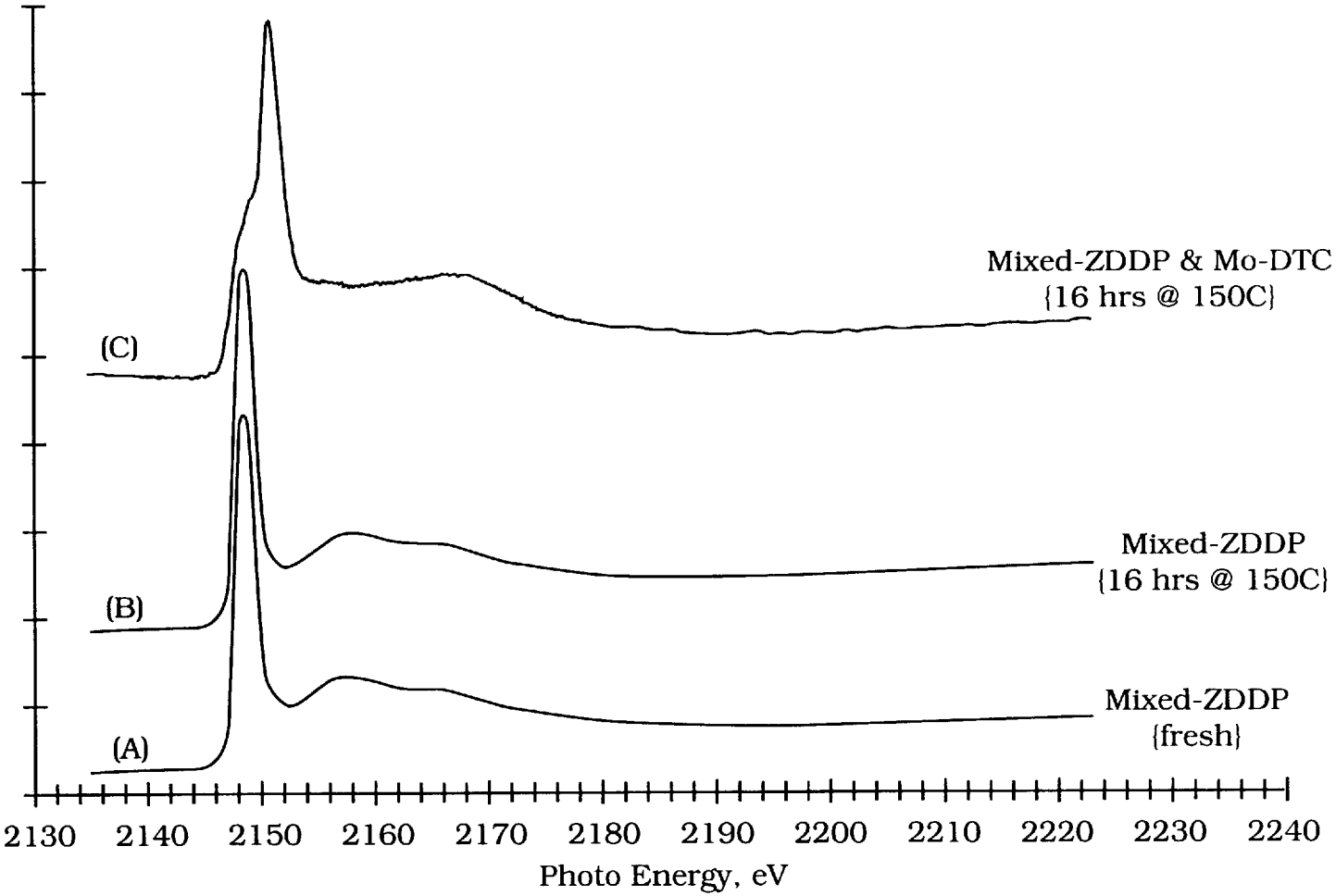
FIG. 1 is the phosphorous XANES spectra of: (A) fresh, unreacted 1% w/w mixed primary/secondary ZDDP in S150N lube basestock; (B) 1% w/w mixed primary/secondary ZDDP in S150N lube basestock heated at 150° C. for 16 hours with an air sparge of 55 cc/min; (C) reaction product of 1% w/w mixed primary/secondary ZDDP combined with 1% Molybdenum Dithiocarbamate (MoDTC) in S150N lube basestock, heated at 150° C. for 16 hours with an air sparge of 55 cc/min. Descriptions of the ZDDP and MoDTC compounds and the reaction and separation procedures are given in Example 1.

The present invention is directed to a multifunctional lube additive formed as the reaction product of a metal dihydrocarbyl dithiophosphate and molybdenum dithiocarbamate in air at a temperature above 135° C., preferably about 150° C. The invention also relates to a lubricant formulation additive that imparts improved antiwear and reduced friction characteristics to the lubricant in which it is employed at a lower phosphorous content as compared to the metal dihydrocarbyl dithiophosphate starting material.

The product is prepared by reacting the metal dihydrocarbyl dithiophosphate and the molybdenum dithiocarbamate in solution (typically and preferably lubricating oil base stock) at a temperature above about 135° C. to about 200° C., preferably at about 150° C. at times sufficient for reaction to occur, preferably for about 8 to 16 hours, with an air sparge sufficient to saturate the mixture with air. Reactant concentrations of 0.1% w/w or greater of each are typically employed.

Any metal dithiophosphate in which the solubilizing ligands are $C_3$—$C_{16}$ primary, secondary, mixed primary-secondary alkyl ligands, and combinations thereof are usable as starting materials in production of the composition of the present invention. While alkyl ligands are preferred, the invention can also be practiced with ligands having organo groups selected from aryl, substituted aryl, and ether groups. Preferably, the solubilizing ligands are $C_3$—$C_{12}$ primary, secondary, mixed primary-secondary alkyl ligands, and combinations thereof. The metallic moiety may be copper, lead, molybdenum, magnesium, calcium, iron, and zinc. Of these zinc, copper, and molybdenum are preferred; zinc is most preferred.

The molybdenum dithiocarbamates (MoDTC) usable as starting materials in production of the composition of the present invention are of the structural formula shown below:

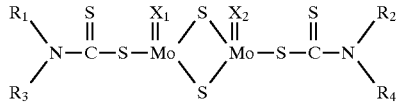

where R1–R4 are independently selected $C_3$—$C_{16}$ primary, secondary, mixed primary-secondary alkyl ligands, and mixtures thereof. $X_1$ and $X_2$ are each, either O or S. While alkyl ligands are preferred, the invention can also be practiced with aryl and alkyl aryl ligands.

In practicing the present invention, the list of usable starting materials is quite broad, being generally defined as metallic dihydrocarbyl dithiophosphates and molybdenum dithiocarbamates, combined in just about any ratio. So long as both starting materials are present, some quantity of the desired reaction products will be formed if the reaction is run in air at a temperature above 135° C., preferably at about 150° C.

The ratio and extent of reaction, and the time required to complete the reaction will depend on the nature of the starting materials within the range of the materials described. Similarly, the solubility of the final product will also depend on the ligand structure of the starting molecules. Because the starting materials must first be put into solution before reaction occurs, materials with chains which are too short will not dissolve sufficiently to facilitate production of the desired reaction product. Thus, the ligands on the metallic dihydrocarbyl dithiophosphate and molybdenum dithiocarbamate are independently selected primary, secondary or mixtures of primary and secondary $C_3$—$C_{16}$ alkyl ligands, provided that the total number of carbon atoms present among the ligand's organo groups is sufficient to render the starting material and reaction product oil soluble.

The starting materials are mixed together in a solvent which may be any material in which both reactants are at least somewhat soluble, which does not compete with or otherwise react with one or the other of the starting materials and which remains chemically and physically stable at the reaction temperature of above about 135° C., preferably about 150° C. and higher. Preferred solvent is the lubricating oil base stock of the type in which the final reaction product is intended for use.

Following reaction, at temperatures of above about 135° C., preferably about 150° C. and higher at times sufficient for reaction to occur, preferably about 8–16 hours at temperatures of about 150° C. with air sparge sufficient to saturate the reaction mixture with air, the soluble product is purified by separation of insoluble materials from the soluble products by methods known to those skilled in the art. The reaction product in the recovered liquid phase will be used in the formulated oil in an amount sufficient to attain the desired molybdenum concentration in the formulated oil.

Alternatively, purified reaction product may be added to a suitable oleagenous carrier in order to form a concentrate for blending with lubricating oils. The amount of purified reaction product ranges from about 1 to about 90% wt. % based on the weight of the carrier and reaction product. Suitable oleagenous carriers include base stock, animal oils, vegetable oils, mineral oil, synthetic oils, and mixtures thereof.

The amount of reaction product per se, measured as a function of molybdenum wt % active ingredient, in the final formulated oil will range from 0.004 wt % to 0.4 wt %, and preferably from 0.005 wt % to 0.2 wt %.

The lubricating composition according to the invention requires a major amount of lubricating oil basestock. In general, the lubricating oil basestock will have a kinematic viscosity ranging from about 2 to about 1,000 cSt at 40° C. The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude.

Natural lubricating oils include animal oils, vegetable oils (e.g., castor oils and lard oil), petroleum oils, mineral oils, and oils derived from coal or shale, and mixtures thereof.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic aids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof, Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The lubricating oil formulation containing the reaction product is compatible with and may also contain one or more of the following classes of additives: viscosity index improvers, antioxidants, friction modifiers, antifoamants, anti-wear agents, corrosion inhibitors, hydrolytic stabilizers, metal deactivator, detergents, dispersants, pour point depressants, extreme pressure additives, etc.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11, the disclosures of which are incorporated herein by reference.

This invention may be further understood by reference to, but not limited by, the following examples which include preferred embodiments.

EXAMPLE 1

I. Synthesis and Chemical Analysis of the Reaction Product

In the first example, we start with a commercial mixed primary-secondary zinc dialkyl dithiophosphate (ECA 6654 available from Exxon Chemical Company) and a commercial molybdenumn dithiocarbamate (Sakura Lube 155 available from Asahi Denka Kogyo). Each additive is present at concentration 1% w/w in S150N mineral lube base stock. The compounds, individually at 1% w/w and in combination at 1% w/w each are subjected to reaction conditions of 150° C. for 16 hours with an air sparge of 55 cc/min. The oil soluble reaction product is separated and the liquid phase is decanted. The spectra in FIGS. 1 through 4 and the performance data in Tables 1 and 2 were obtained with the above described liquid product.

XANES (X-Ray Absorption Near Edge Spectroscopy) and EXAFS (Extended X-Ray Absorption Fine Structure) spectroscopy data were acquired from the starting materials and the reaction products. The spectra reported here were obtained using standard practices as described in "*X-Ray Absorption: Principles, Applications Techniques of EXAFS, SEXAFS and XANES*", D. C. Koningsberger & R. Prins Editors, John Wiley & Sons (1988). The sulfur intensities have been normalized to equivalent sulfur concentrations.

Figure 2:
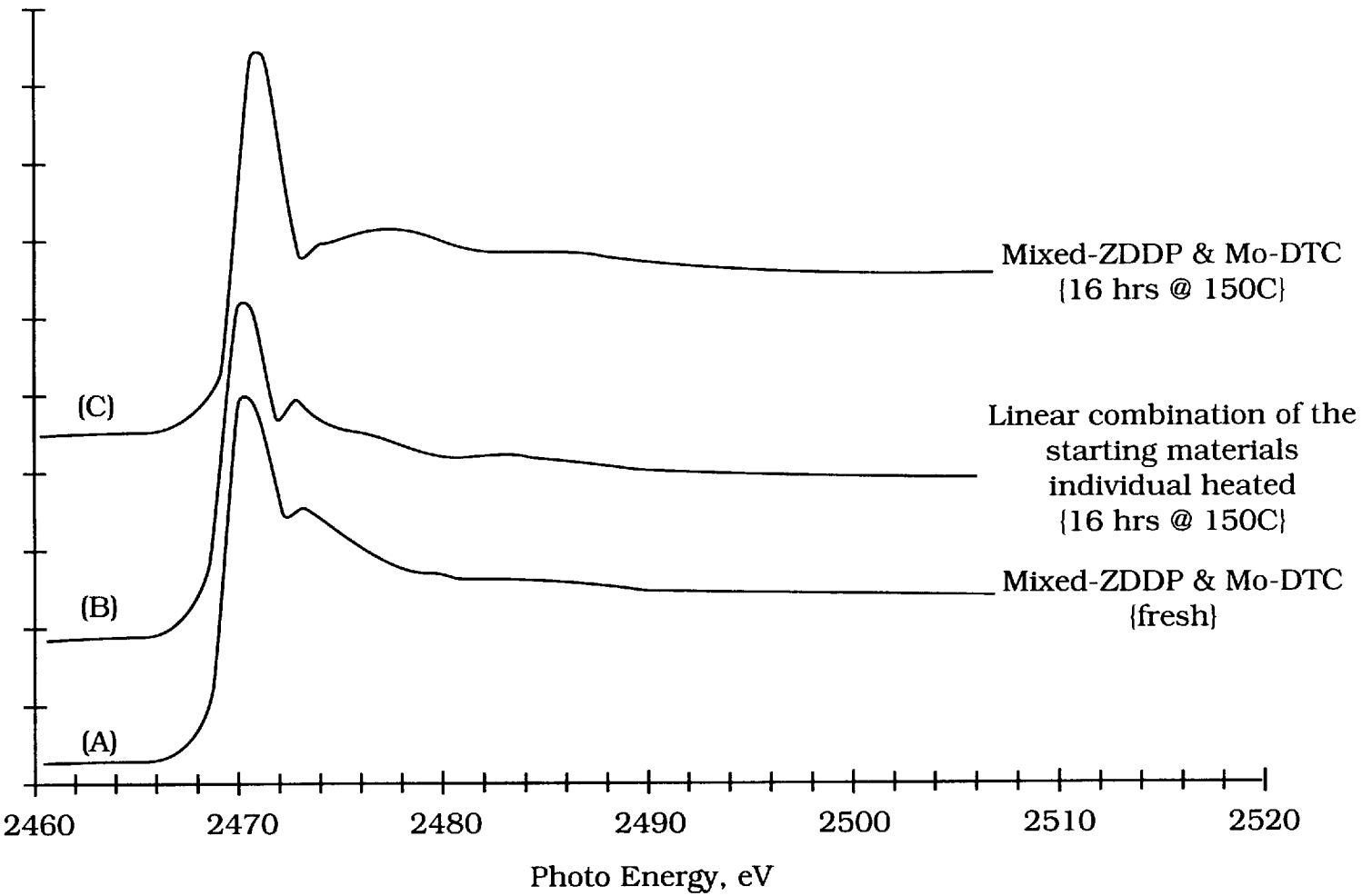
FIG. 2 is the sulfur XANES spectra of: (A) fresh, unreacted 1% w/w mixed primary/secondary ZDDP combined with 1% MoDTC in S150N lube basestock; (B) linear combination of the XANES spectra of the starting materials, i.e., mixed primary/secondary ZDDP and Molybdenum Dithiocarbamate (MoDTC) individually heated at 1% w/w in S150N lube basestock at 150° C. for 16 hours with an air sparge of 55 cc/min; (C) reaction product of 1% w/w mixed primary/secondary ZDDP combined with 1% MoDTC in S150N lube basestock, heated at 150° C. for 16 hours with an air sparge of 55 cc/min. Descriptions of the ZDDP and MoDTC compounds and the reaction and separation procedures are given in Example 1.
Figure 3:
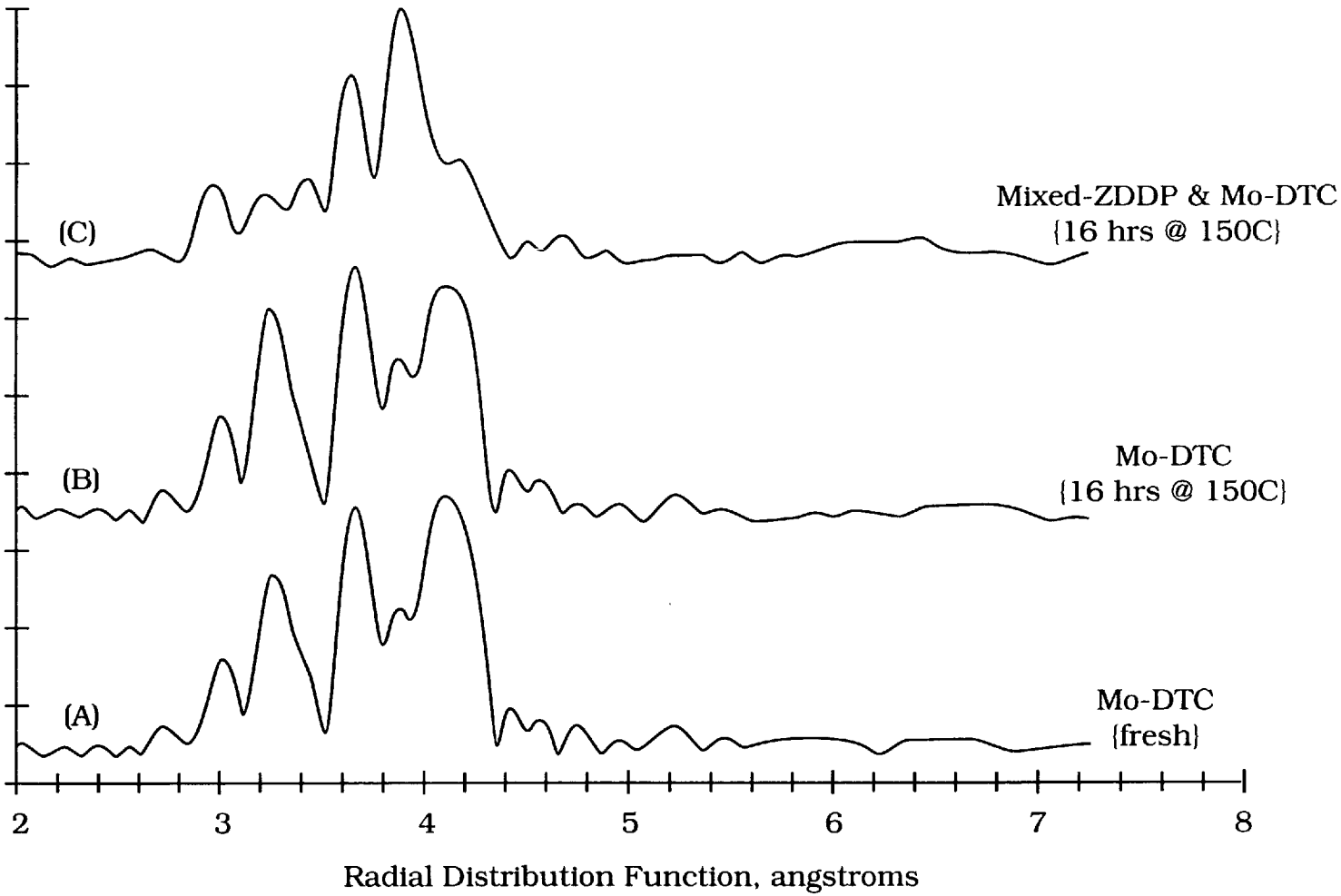
FIG. 3 is a radial distribution function, centered on the molybdenum atom, derived from the molybdenum EXAFS spectra of: (A) fresh, unreacted 1% w/w MoDTC in S150N lube basestock, (B) 1% w/w MoDTC in S150N lube basestock heated at 150 ° C. for 16 hours with an air sparge of 55 cc/min, and (C) reaction product of 1% w/w mixed primary/secondary ZDDP combined with 1% w/w MoDTC in S150N lube basestock, heated at 150 ° C. for 16 hours with an air sparge of 55 cc/min. Descriptions of the ZDDP and MoDTC compounds and the reaction and separation procedures are given in Example 1.
Figure 4:
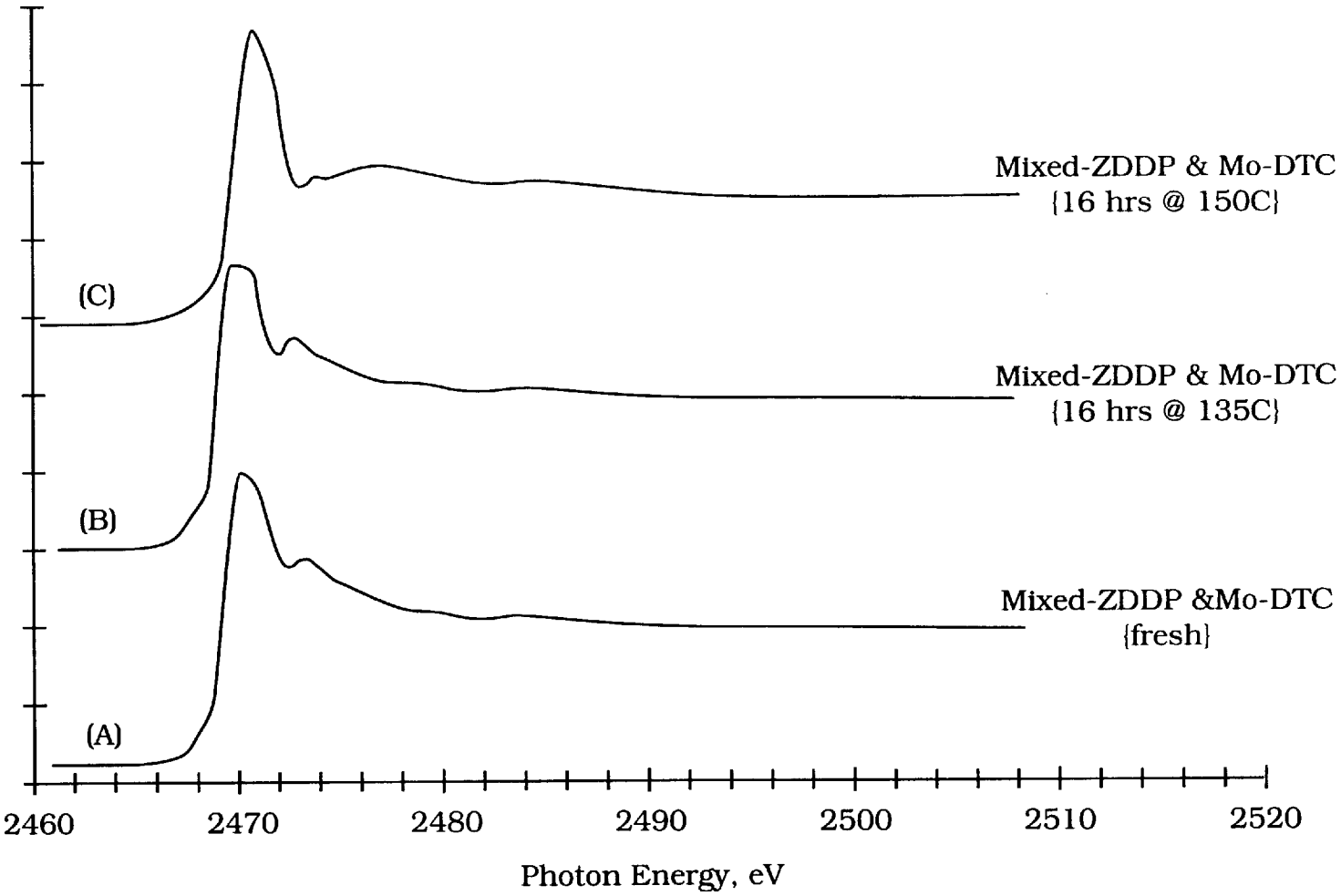
FIG. 4 is the sulfur XANES spectra of: (A) fresh, unreacted 1% w/w mixed primary/secondary ZDDP combined with 1% MoDTC in S150N lube basestock (B) reaction product of 1% w/w mixed primary/secondary ZDDP combined with 1% w/w MoDTC in S150N lube basestock, heated at 135° C. for 16 hours with an air sparge of 55 cc/min, and (C) reaction product of 1% w/w mixed primary/secondary ZDDP combined with 1% w/w MoDTC in S150N lube basestock, heated at 150° C. for 16 hours with an air sparge of 55 cc/min. Descriptions of the ZDDP and MoDTC compounds and the reaction and separation procedures are given in Example 1.

FIGS. 1, 2 and 4 respectively compare the phosphorous (FIG. 1), sulfur (FIG. 2 and 4) XANES spectra, and the molybdenum radial distribution function based on EXAFS spectra (FIG. 3) of the initial reactants in their unreacted fresh condition, the individual reactants after heating to 150° C. for 16 hours with an air sparge, and the reaction product of this invention.

FIG. 1 shows that no change occurs in the chemical structure of the soluble phosphorous on heating the zincdihydrocarbyl dithiophosphate alone to 150° C. in air for 16 hours. See spectra A and B. In contrast heating the zinc dihydrocarbyl dithiophosphate in the presence of the molybdenum dithiocarbamate at 150° C. in air for 16 hours results in the formation of the reaction product. See spectrum C. Comparing samples 7 and 8 in Table 1 shows that the reaction product improves the friction and wear performance in a lubricating composition in the presence of only half the phosphorous present in the unreacted mixture of lubricating oils and starting materials (see the discussion of the performance data in the following section).

FIG. 2 illustrates the chemical changes which occur to the sulfur moieties in the starting materials during the formation of the reaction product of this invention. As can be seen from FIG. 2, heating the metal dihydrocarbyl dithiophosphate in the presence of the molybdenum dithiocarbamate at 150° C. in air for 16 hours results in the conversion of the sulfur to a new chemical form. The sulfur spectrum of the reaction product formed in this invention (spectrum C) is not the same as that of the fresh mixed ZDDP and MoDTC combination (spectrum A) and it is different from the spectrum obtained by a linear superposition of the spectra of the starting materials heated individually at 1% w/w concentration in S150N base stock at 150° C. in air (spectrum B). The existence of a reaction product of this invention is shown by the change in the sulfur XANES spectra of FIG. 2 (spectrum C).

FIG. 3 illustrates the changes in the radial distribution function (RDF) centered on the molybdenum EXAFS contained in the product and starting materials of this invention. Comparing the molybdenum RDF of the molybdenum dithiocarbamate starting material (A) and the product of oxidizing the molybdenum dithiocarbamate alone at 150° C. for 16 hours in air (B) shows that no substantial change in the chemical coordination of the molybdenum has occurred. In contrast, when the molybdenum dithiocarbamate starting material is heated in the presence of the zinc dithiocarbyl dithiophosphate of Example 1, the RDF is radically changed indicating a change in the chemical coordination of the molybdenum atoms (C). The existence of a reaction product is shown by the molybdenum RDF in spectrum C of FIG. 3.

The reaction product of the present invention is not formed in-situ in engines run using formulated lubricating oils containing, e.g., zinc dialkyldithio phosphates (ZDDP) and molybdenum dithiocarbamates (MoDTC). The sump temperatures in engines are usually below 135° C., which was shown to be a threshold temperature below which the reaction will not occur. This is illustrated in FIG. 4, which shows that no change to the sulfur moeities occurs upon heating the metal dihydrocarbyl dithiophosphate in the presence of molybdenum dithiocarbamate at 135° C. in air for 16 hours (see spectrum B). In contrast, heating the two compounds at 150° C., results in the formation of new products (spectrum C in FIG. 4). Furthermore, the presence of blowby gases in the crankcase oil and $NO_x$ in particular are known to degrade ZDDP and MoDTC, which in turn will slow down or eliminate the formation of the reaction product. As shown by Johnston et al (M. D. Johnson, S. Korcek and M. J. Rokosz, Lubrication Science, 6–3, 247 (1994)), $NO_x$ initiated oxidation processes and direct interactions between $NO_2$ and ZDDP derived intermediates accelerate the consumption of ZDDP. Arai, et al (K. Arai, M. Yamada, S. Asano, S. Yoshizawa, H. Ohira, I. Hoshino, F. Ueda, I. Akiyama, SAE 952533 (1995)) also reported deterioration of MoDTC and ZDDP in the presence of $NO_2$ which was reflected in an increase in the friction coefficient. The presence of other additives in fully formulated engine oils are also expected to affect the reaction. For example, ashless dispersants are known to interact with ZDDP and would be expected to inhibit formation of the reaction product of the present invention.

II. Performance Data

The compounds, mixtures, and reaction products studied in example 1 were evaluated for friction and wear performance using a Falex block-on-ring tribometer. Average friction coefficients were measured during the experimental runs under 670N load applied on the block for 2.0 hours at 100° C. Wear scars on the block at the end of the experiment were measured by profilometry.

In Tables 1 and 2, samples 8 and 14 show results for lube oils containing the reaction product additive of the present invention. As in the case of the spectroscopy data, the reaction product's properties are compared with those of MoDTC and ZDDP in Solvent 150 neutral (S150N) base stock. Two different concentrations of 1% w/w of each additive (1% w/w MoDTC and 1% w/w ZDDP) and 0.5% w/w of each additive (0.5% w/w MoDTC and 0.5% w/w ZDDP) are chosen, as demonstrated in Tables 1 and 2, respectively.

The data in Tables 1 and 2 indicate that the new class of compounds (samples 8 and 14) provide an excellent combination of low friction and low wear performance. Furthermore, the new class of compounds, samples 8 and 14, have lower phosphorous concentrations compared with the unreacted compounds samples 7 and 13, respectively. As measured by Inductively Coupled Plasma Atomic Emission Spectroscopy, the phosphorous concentration in sample 8 is 393 wppm compared with 813 wppm in sample 7. Similarly, the phosphorous concentration in sample 14 is 310 wppm compared with 418 wppm in sample 13. As explained in the introduction, low phosphorous levels are desirable for the longevity of catalytic converters in modern vehicles.

TABLE 1

| | Average Friction Coefficient | Wear Scar Volume × 100 ($mm^3$) |
|---|---|---|
| Sample 1 | 0.101 | 1.87 |
| Sample 2 | 0.102 | 1.88 |
| Sample 3 | 0.117 | 0.27 |
| Sample 4 | 0.117 | 0.25 |
| Sample 5 | 0.046 | 1.33 |
| Sample 6 | 0.058 | 1.98 |
| Sample 7 | 0.057 (average of 2 runs) | 0.70 (average of 2 runs) |
| Sample 8 | 0.053 (average of 2 runs) | 0.62 (average of 2 runs) |

Sample 1: S150N base stock.

Sample 2: S150N base stock heated in air for 16 hours at 150° C.

Sample 3: 2% w/w mixed ZDDP in S150N

Sample 4: 2% w/w mixed ZDDP in S150N heated in air for 16 hours at 150° C.

Sample 5: 2% w/w MoDTC in S150N

Sample 6: 2% w/w MoDTC in S150N heated in air for 16 hours at 150° C.

Sample 7: 1% w/w mixed ZDDP combined with 1% w/w MoDTC in S150N

Sample 8: Reaction product of 1% w/w mixed ZDDP combined with 1% w/w

MoDTC in S150N heated in air for 16 hours at 150° C.

TABLE 2

| | Average Friction Coefficient | Wear Scar Volume × 100 ($mm^3$) |
|---|---|---|
| Sample 9 | 0.116 (average of 4 runs) | 0.47 (average of 4 runs) |
| Sample 10 | 0.111 (average of 6 runs) | 1.06 (average of 6 runs) |
| Sample 11 | 0.052 | 2.14 |
| Sample 12 | 0.069 | 2.69 |

TABLE 2-continued

| | Average Friction Coefficient | Wear Scar Volume × 100 ($mm^3$) |
|---|---|---|
| Sample 13 | 0.063 | 0.60 |
| Sample 14 | 0.047 | 0.54 |

Sample 9: 1% w/w mixed ZDDP in S150N

Sample 10: 1% w/w mixed ZDDP in S150N heated in air for 16 hours at 150° C.

Sample 11: 1% w/w MoDTC in S150N

Sample 12: 1% w/w MoDTC in S150N heated in air for 16 hours at 150° C.

Sample 13: 0.5% w/w mixed ZDDP combined with 0.5% w/w MoDTC in

S150N

Sample 14: Reaction product of 0.5% w/w mixed ZDDP combined with 0.5% w/w MoDTC in S150N heated in air for 16 hours at 150° C.

EXAMPLE 2

I. Synthesis and Chemical Analysis of the Reaction Product

In the second example, we start with a commercial primary zinc dialkyl dithiophosphate (Additin RC3180 available from Rhein Chemie) and a commercial molybdenum dithiocarbamate (Sakura Lube 155 available from Asahi Denka Kogyo). Each additive is present at concentration 1% w/w in S150N mineral lube base stock. The compounds, individually at 1% w/w and in combination at 1% w/w are subjected to reaction conditions of 150° C. for 16 hours with an air sparge of 55 cc/min. The crude product is dialysis filtered through a latex membrane using pentane as the carrier. Following dialysis filtration, the pentane solvent is removed by distillation. The product of this invention is recovered as the oil soluble product that passes through the membrane. The EXAFS spectrum (C) in FIG. 5 and the performance data in Table 3 were obtained with the above described liquid product.

Figure 5:
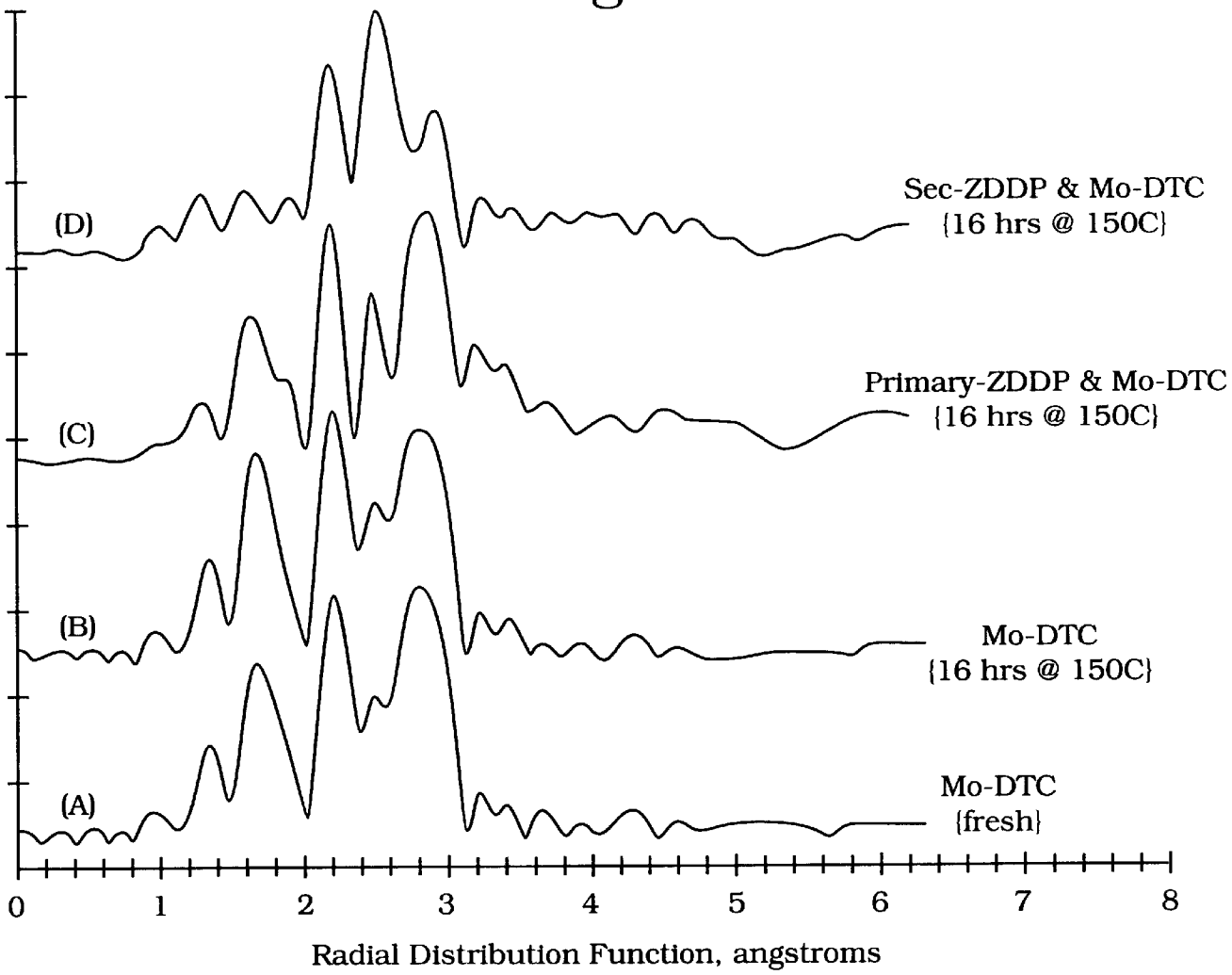
FIG. 5 is a radial distribution function, centered on the molybdenum atom, derived from the molybdenum EXAFS spectra of: (A) fresh, unreacted 1% w/w MoDTC in S150N lube basestock, (B) 1% w/w MoDTC in S150N lube basestock heated at 150° C. for 16 hours with an air sparge of 55 cc/min, (C) reaction product of 1% w/w primary ZDDP combined with 1% w/w MoDTC in S150N lube basestock heated at 150° C for 16 hours with an air sparge of 55 cc/min as described in Example 2, and (D) reaction product of 1% w/w secondary ZDDP combined with 1% w/w MoDTC in S150N lube basestock, heated at 150° C. for 16 hours with an air sparge of 55 cc/min as described in Example 3.

In FIG. 5, the radial distribution function centered on the molybdenum atom derived from the molybdenum EXAFS of the reaction product of this invention (spectrum C) is compared with the spectra of the "fresh" 1% w/w MoDTC in S150N base stock (spectrum A) and the heated 1% w/w MoDTC solution at 150° C. for 16 hours (spectrum B). The reaction product of this invention is distinctly different from the heated MoDTC sample and is characterized by a change in the coordination of Mo.

II. Performance Data

The frictional and anti-wear characteristics of the compounds under study in Example 2 were evaluated using a Falex block-on-ring tribometer; the test conditions were the same as described in Example 1.

Table 3, summarizes the average friction coefficients and wear scar volumes on the block of the Falex tribometer at the end of the experiment. Sample 16 represents the reaction product of this invention, as described in Example 2. Its performance is compared with the performance of the "fresh", unreacted mixture of primary ZDDP and MoDTC utilized in Example 2. The data in Table 3 show that the reaction product of this invention, Sample 16, has improved friction and wear performance. Furthermore, the product of this invention has lower phosphorous concentration. As measured by Inductively Coupled Plasma Atomic Emission Spectroscopy, the phosphorous concentration in Sample 16 of Table 3 is 680 wppm compared with 780 wppm in Sample 15.

TABLE 3

| | Average Fiction Coefficient | Wear Scar Volume × 100 ($mm^3$) |
|---|---|---|
| Sample 15 | 0.043 | 2.34 |
| Sample 16 | 0.042 | 0.73 |

Sample 15: 1% w/w primary ZDDP mixed with 1% w/w MoDTC in S150N

Sample 16: Reaction product of 1% w/w primary ZDDP mixed with 1% w/w

MoDTC in S150N heated as described in Example 2

EXAMPLE 3

I. Synthesis and Chemical Analysis of the Reaction Product

In the third example, we start with a commercial secondary zinc dialkyl dithiophosphate (Parabar 9419 available from Exxon Chemical Company) and a commercial molybdenum dithiocarbamate (Sakura Lube 155 available from Asahi Denka Kogyo). Each additive is present at concentration 1% w/w in S150N mineral lube base stock. The compounds, individually at 1% w/w and in combination at 1% w/w are subjected to reaction conditions of 150° C. for 16 hours with an air sparge of 55 cc/min. The crude product is dialysis filtered through a latex membrane using pentane as the carrier. Following dialysis filtration, the pentane solvent is removed by distillation. The product of this invention is recovered as the oil soluble product that passes through the membrane. The EXAFS spectrum (D) in FIG. 5 and the performance data in Table 4 were obtained with the above described liquid product.

In FIG. 5, the radial distribution function centered on the molybdenum atom derived from the molybdenum EXAFS (spectrum D) of the reaction product of this invention is compared with the spectra of the "fresh" 1% w/w MoDTC in S 150N base stock (spectrum A) and the heated 1% w/w MoDTC solution at 150° C. for 16 hours (spectrum B). The reaction product of this invention is distinctly different and is characterized by a change in the coordination of Mo.

II. Performance Data

The frictional and anti-wear characteristics of the compounds under study in Example 3 were evaluated using the Falex block-on-ring tribometer; the test conditions were the same as described in Example 1.

Table 4, summarizes the average friction coefficients and wear scar volumes on the block of Falex tribometer at the end of the experiments. Sample 18 represents the reaction product of this invention, as described in Example 3. Its performance is compared with the performance of the "fresh", unreacted mixture of secondary ZDDP and MoDTC utilized in Example 3. The data in Table 4 show that the reaction product of this invention, Sample 18, has improved wear performance. Furthermore, the product of this invention has lower phosphorous concentration compared with the starting materials. As measured by Inductively Coupled Plasma Atomic Emission Spectroscopy, the phosphorous concentration in Sample 18 of Table 4 is below 160 wppm (detection limit for phosphorous) compared with 770 wppm in Sample 17.

TABLE 4

| | Average Fiction Coefficient | Wear Scar Volume × 100 ($mm^3$) |
|---|---|---|
| Sample 17 | 0.053 | 0.87 |
| Sample 18 | 0.053 | 0.67 |

Sample 17: 1% w/w secondary ZDDP mixed with 1% w/w MoDTC in S150N

Sample 18: Reaction product of 1% w/w secondary ZDDP with 1% w/w

MoDTC in S150N heated, as described in Example 3.

What is claimed is:

1. A method for forming a lubricating composition having a reaction product comprising:

adding to a major amount of an oil of lubricating viscosity a minor amount of a metal dihydrocarbyl dithiophosphate and a molybdenum dithiocarbamate and heating the admixture with an air sparge sufficient to saturate the admixture with air to a temperature ranging from above about 135° C. to about 200° C. thereby forming the lubricating composition having a reaction product.

2. The method of claim 1 further comprising the step of separating insoluble material from the lubricating composition and providing a purified lubricating composition.

3. A lubricating composition having a reaction product formed by adding to a major amount of an oil of lubricating viscosity a minor amount of a metal dihydrocarbyl dithiophosphate and a molybdenum dithiocarbamate and heating the admixture with an air sparge sufficient to saturate the admixture with air to a temperature ranging from above 135° C. to about 200° C. thereby forming the lubricating composition having a reaction product.

4. The lubricating composition having a reaction product according to claim 3 wherein insoluble material has been separated from the composition.

5. A composition according to claim 3 wherein the reaction product ranges from about 1 wt. % to about 90 wt. %.

6. A method for enhancing the friction reducing and wear reducing properties of a lubricating composition having a major amount of an oil of lubricating viscosity, comprising:

heating the lubricating composition to a temperature ranging from about 135° C. to about 200° C. in the presence of an air sparge sufficient to saturate the mixture with air, a metal dihydrocaroyl dithiophosphate, and a molybdenum dithiocarbamate.

* * * * *